US005879041A

United States Patent [19]

Sutherland

[11] Patent Number: 5,879,041

[45] Date of Patent: Mar. 9, 1999

[54] NESTABLE BASKET CARRIER

[75] Inventor: Robert L. Sutherland, Kennesaw, Ga.

[73] Assignee: Riverwood International Corporation, Atlanta, Ga.

[21] Appl. No.: 948,470

[22] Filed: Oct. 10, 1997

[51] Int. Cl.[6] ..... B65D 75/00

[52] U.S. Cl. ..... 294/159; 206/180; 229/117.14

[58] Field of Search ..... 294/159, 87.1, 294/87.2; 206/139, 142, 143, 180, 185, 190, 191, 193, 200; 229/117.09, 117.12, 117.13, 117.14, 117.23; 220/509, 515

[56] References Cited

U.S. PATENT DOCUMENTS

| | | | |
|---|---|---|---|
| 2,097,941 | 11/1937 | Wells et al. | 206/193 |
| 2,694,596 | 11/1954 | Greenlaw et al. | 294/87.2 |
| 2,881,946 | 4/1959 | Bosrock et al. | 206/180 |
| 2,942,756 | 6/1960 | Collura et al. | 229/117.13 |
| 4,339,032 | 7/1982 | Wood | 294/87.2 |
| 4,530,460 | 7/1985 | Hinton | 229/117.13 |
| 5,531,319 | 7/1996 | Harrelson | 206/180 |

*Primary Examiner*—Dean Kramer

[57] ABSTRACT

A basket-style carrier for packaging bottles or other articles on opposite sides of a center handle panel. The carrier is formed from an elongated blank including a partial end panel section at one end and a handle panel section at the other end. A handle reinforcement flap is foldably connected to the upper edge of the handle panel. The reinforcement flap of one blank abuts the lower edge of the handle panel section of an adjacent blank in a web layout, allowing the blanks in the layout to be nested.

6 Claims, 4 Drawing Sheets

NESTABLE BASKET CARRIER

FIELD OF THE INVENTION

This invention relates to a basket-style carrier for packaging articles such as beverage bottles. More particularly, it relates to a basket-style carrier which can be produced more economically while still providing adequate strength and stability.

BACKGROUND OF THE INVENTION

Basket-style carriers are commonly employed to package beverage bottles. They typically include a central handle panel located between spaced parallel side panels, a bottom panel connected to the side panels and end panels connected to both the side panels and the handle panel. Typically, basket-style carriers of this type are fabricated from blanks in which the side panel sections are spaced from each other by handle forming sections, and each side panel section is flanked by two end panel flaps. The end panel flaps and one of the handle panel sections typically are connected to riser panels which connect the handle panel to the end panels in the carrier. Bottom panel flaps for forming the bottom panel are connected to the side panel sections.

A problem with this arrangement is that substantial amounts of paperboard stock are required to form the blank, not only because of the size of the blank but because the blank layout does not lend itself to tight nesting in the web from which the blanks are cut. Further, gluing of the carrier elements cannot be carried out with a straight line gluer, which is a more economical way to apply glue to a blank during the carrier forming process.

An object of the invention, therefore, is to provide a basket carrier which can be formed from a more efficient layout with respect to material usage and the required gluing pattern. Another object is to provide such a carrier which not only possesses adequate strength and rigidity, but also presents a pleasing design appearance.

BRIEF SUMMARY OF THE INVENTION

The carrier of the invention comprises a bottom panel, a pair of opposite end panels, one of which is comprised of two partially overlapping end panel sections, a central handle panel and a pair of opposite side panels connected to both the bottom panel and the end panels. One end of the handle panel is foldably connected to one of the end panel sections. The other end is foldably connected to a glue flap adhered to the opposite end panel. In addition, the upper edges of the end panels terminate at substantially the upper edge of the handle panel.

In a preferred arrangement the handle panel includes a handle reinforcement flap foldably connected to the upper edge of the handle panel, and the handle panel is spaced from the bottom panel a distance substantially equal to the height of the handle reinforcement flap. With this arrangement carrier blanks can be nested in an economic web layout in which the upper edge of the handle panel section of one blank lies in a substantially common plane with the lower edges of the side panel sections of an adjacent blank. The lower edge of the handle panel of the carrier is thereby spaced from the bottom panel by an amount equal to the height of the reinforcement flap. The end panels may also be spaced, at least along a portion of their lower edges, from the bottom panel of the carrier a distance substantially equal to the height of the handle reinforcement flap.

In a second embodiment, the end panels and the side panels may contain vertical fold lines, whereby portions of the end and side panels between the vertical fold lines are able to fold to positions which substantially conform to the curved surfaces of adjacent packaged bottles or other articles.

The carrier is strong and pleasing in appearance, and the blank from which it is formed employs a minimum of stock. In addition, the fact that the blanks can be nested in the web layout is an added economic factor. Also, the blank design allows in-line gluing, which allows faster production speeds. These and other features and aspects of the invention will be readily ascertained from the detailed description of the preferred embodiments described below.

DETAILED DESCRIPTION OF THE PREFERRED EMBODIMENTS

Figure 1:
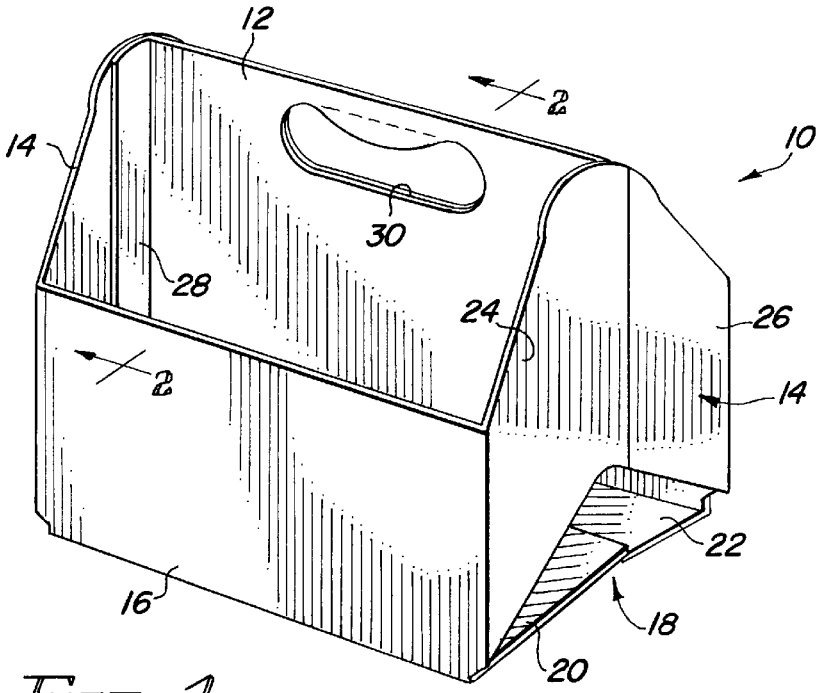
FIG. 1 is a pictorial view of a basket-style carrier incorporating the invention.
Figure 2:
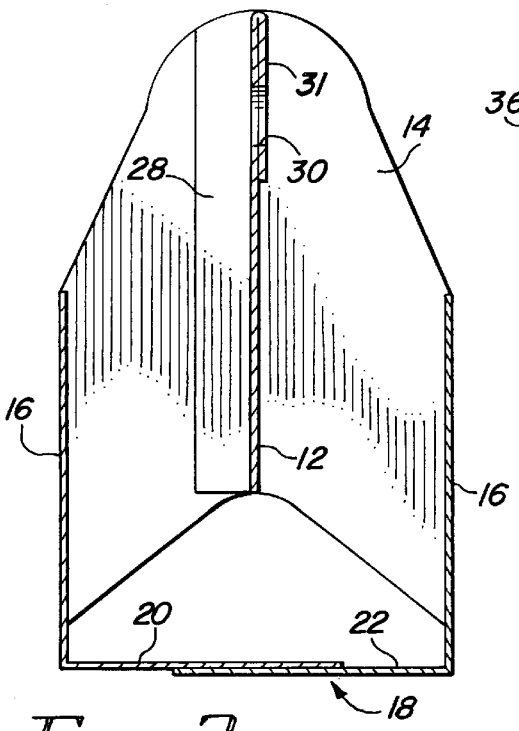
FIG. 2 is a transverse sectional view taken on line 2—2 of FIG. 1.

Referring to FIGS. 1 and 2, the basket-style carrier 10 of the invention includes a central handle panel 12 connected to end panels 14. The end panels are connected to side panels 16, and the side panels are connected to bottom panel 18, which is made up of overlapping bottom panel flaps 20 and 22. As shown in FIG. 1, one of the end panels is comprised of overlapping end panel sections 24 and 26. The other end panel is of integral construction to which the handle panel glue flap 28 is adhered. The lower edges of the end panels are tapered upwardly from points near the bottom panel, so that the lower edges are spaced from the bottom panel, with the spacing being greatest at the centerline of the carrier. Included in the handle panel, which extends down to the uppermost point of the end panel spaces, is handle opening 30. Also, as shown in FIG. 2, a handle reinforcement flap 31 foldably connected to the handle panel 12 extends down a distance sufficient to contain a handle opening aligned with the opening in the handle panel.

Figure 3:
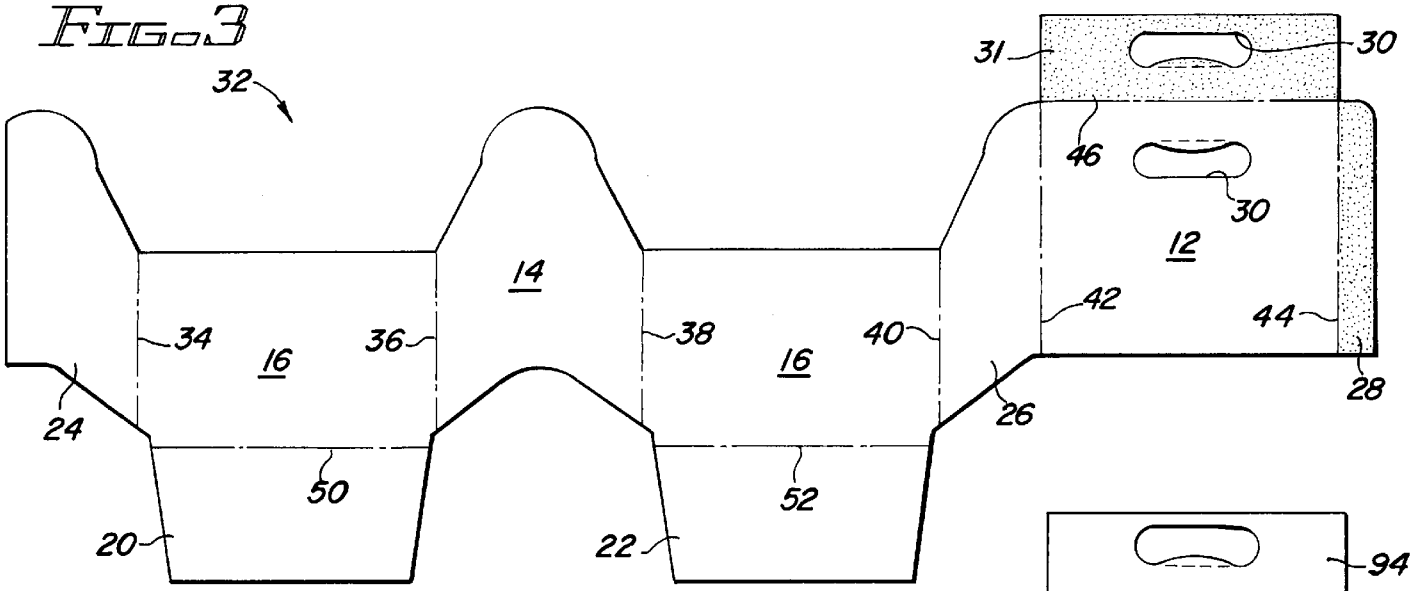
FIG. 3 is a plan view of a blank for fabricating the carrier.

Referring to FIG. 3, wherein like reference numerals to those used in FIGS. 1 and 2 denote like elements, an elongated blank formed of paperboard or other suitably strong and flexible material is indicated at 32. At one end of the blank partial end panel flap 24 is connected by fold line 34 to one of the side panel sections 16, which in turn is connected by fold line 36 to end panel section 14. The other side panel section 16 is connected to the end panel section 14 by fold line 38 and to partial end panel section 26 by fold line 40. At the other end of the blank the handle panel section 12 is connected to the partial end panel section 26 by fold line 42 and to glue flap 28 by fold line 44. Connected by fold line 46 to the upper edge of the handle panel section 12 is handle reinforcement flap 31 which, like the handle panel section 12, contains a handle opening 30. The bottom panel flap 20 is connected to the side panel section 16 at the left of the drawing by fold line 50, while the bottom panel flap 22 is connected to the other side panel section 16 by fold line 52. The fold lines 34, 36, 38, 40, 42 and 44 are parallel to each other and extend vertically in a carrier formed from the blank, while the fold lines 50, 52 and 46 form substantially right angles with the vertical fold lines.

To form a carrier from the blank glue is applied to the handle reinforcement flap 31 and to the glue flap 28, as shown in stipple in FIG. 3. The handle reinforcement flap 31 is folded down about the fold line 46 to adhere it to the upper portion of the handle panel section 12 so as to make the area surrounding the aligned handle openings 30 of two-ply construction. The blank is then folded about the fold line 40 so that the glue flap 28 is adhered to the end panel section 14. The resulting interim configuration of the blank is shown in FIG. 4.

Figure 5:
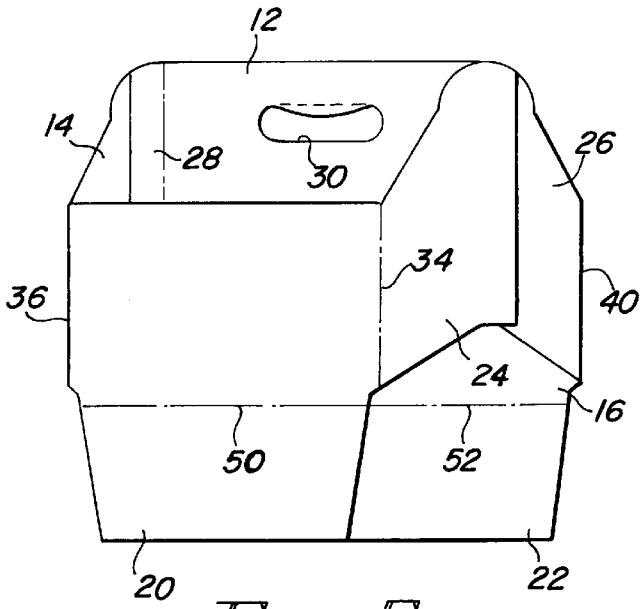
FIG. 5 is a plan view of a collapsed carrier resulting from a final folding and gluing step.
Figure 4:
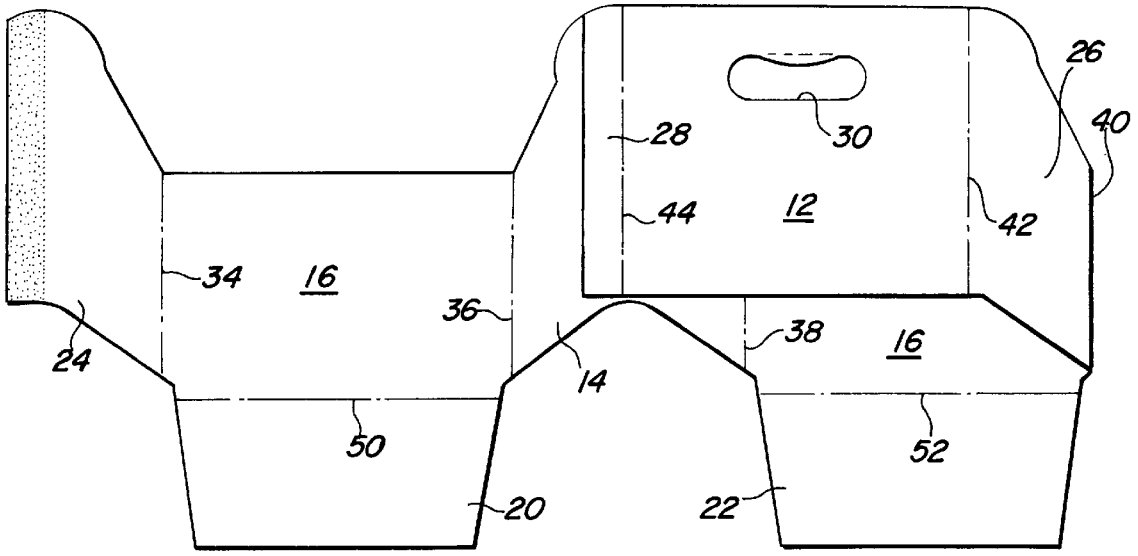
FIG. 4 is a plan view of the carrier blank after initial folding and gluing steps.

Glue is then applied as shown in stipple in FIG. 4 to the edge portion of end panel flap 24. The side panel section 16 at the left of the blank and attached end panel flap 24 are then pivoted about the fold line 36 to the position shown in FIG. 5. This adheres the partially overlapping portion of end panel flap 24 to the end panel section 26, resulting in the illustrated collapsed carrier.

To open the collapsed carrier during the packaging operation inward pressure is applied to the end folded corners of the collapsed carrier, as is well known in the industry. The bottom panel flaps can then be glued together to form the bottom panel and the bottles dropped in from the top, or the open carrier can be lowered over a group of bottles and the bottom panel subsequently formed. In either case the result is a strong basket carrier well suited for holding heavy loads. It is also quite economical to produce, since its design requires a minimum of stock and the gluing and folding operations are relatively simple. The gluing steps are notably economical and fast, inasmuch as they can be carried out by an in-line gluer.

Figure 6:
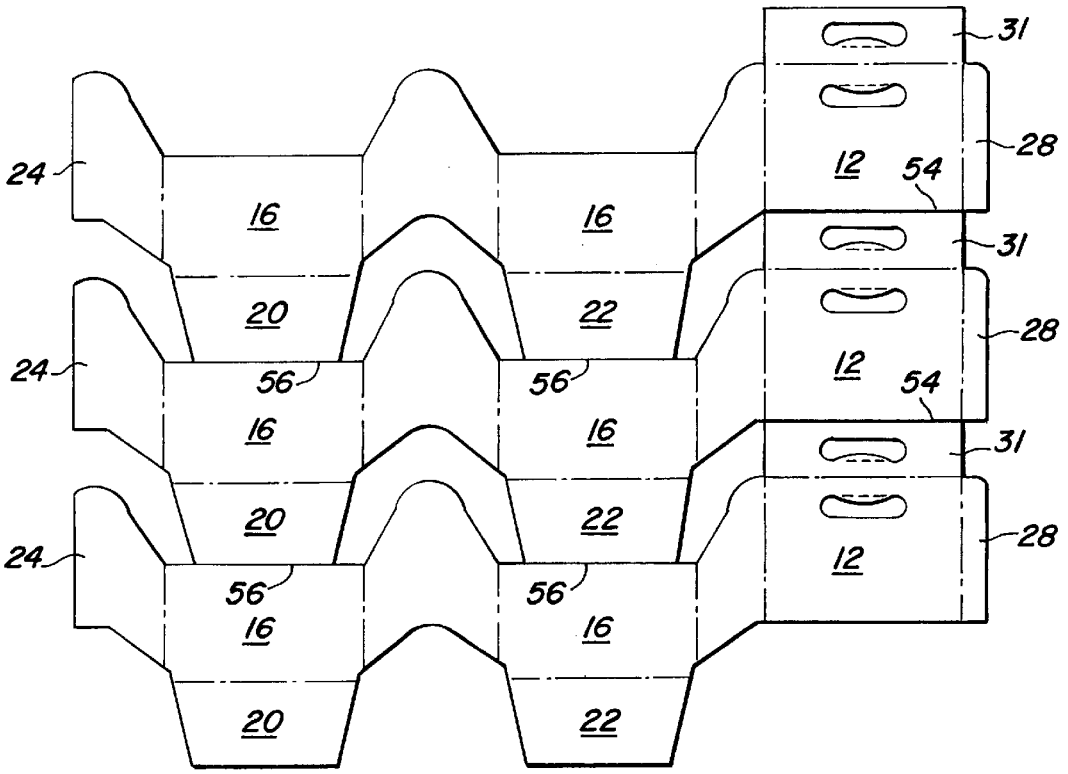
FIG. 6 is a plan view of several of the carrier blanks in nested relationship.

In addition to these benefits the carrier design has the added benefit of enabling the blanks to be laid out in the web from which they are cut in an economical nesting arrangement. Referring to FIG. 6, several of the blanks are shown in their nested arrangement. It can be seen that the upper edge of the handle reinforcement flap 31 of one blank abuts the lower edge of the handle panel of one adjacent blank, as defined by slit 54, and that the lower edges of the bottom panel flaps 20 and 22 abut the upper edges of the side panel sections 16 of the other adjacent blank, as defined by slits 56. This compact layout leaves only small gaps between the end panel flaps 24 and the end panel sections 14 and 26, the size of the gaps substantially corresponding to the height of the handle reinforcement flaps 31. These gaps produce the open spaces between the bottom panel and the lower edge of the end panels illustrated in FIG. 1. The design is not only pleasing to the eye but allows greater visibility of the end bottles, a feature which is important to customer appeal.

Figure 7:
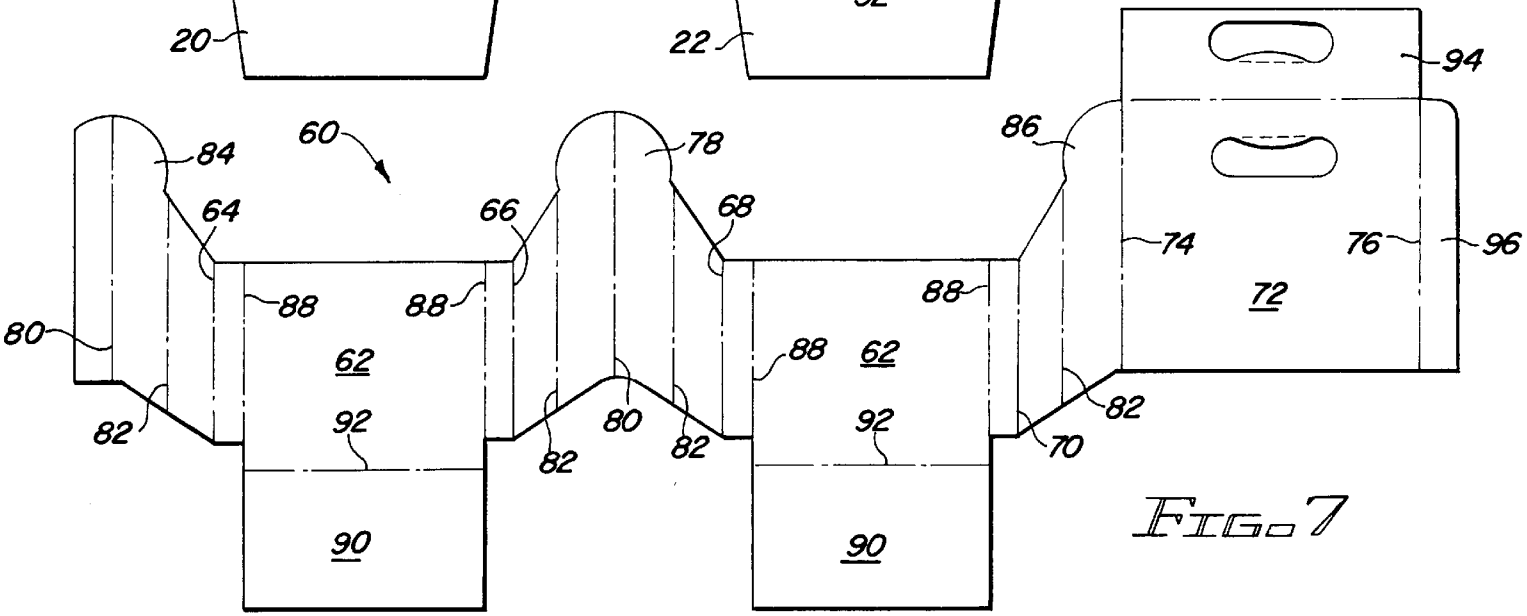
FIG. 7 is a plan view of a modified carrier blank.

A modified design of the invention is shown in FIG. 7. In the blank 60 of this embodiment the width of the side panel section 62 at the left of the blank is defined by the fold lines 64 and 66 and the width of the other side panel section 62 is defined by the fold lines 68 and 70. The width of the handle panel section 72 is defined by the fold lines 74 and 76. The end panel section 78 includes a central fold line 80 and fold lines 82 located between the fold line 80 and the fold lines 66 and 68. Similarly, the end panel flap 84 includes fold lines 80 and 82, and the partial end panel section 86 also includes a fold line 82. In addition, the side panel sections 62 include fold lines 88 inwardly spaced from the boundary fold lines 64, 66, 68 and 70. The end edges of the bottom panel flaps 90, which are connected to the side panel sections by fold lines 92, are inwardly recessed and aligned with the fold lines 88, making for a bottom panel of lesser width than the bottom panel of the first embodiment. The blank further includes a handle reinforcement flap 94 and a glue flap 96. The blank is of the same general configuration as, and can be laid out in nesting fashion similar to, the layout of the first embodiment.

Figure 8:
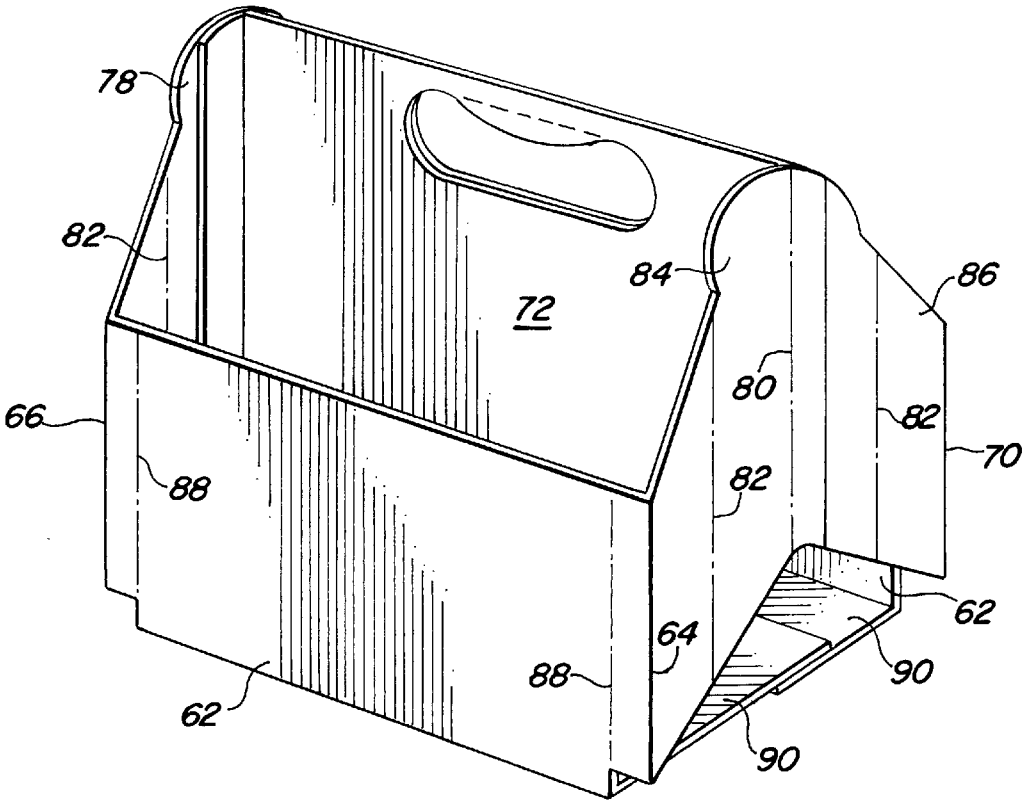
FIG. 8 is a pictorial view of a carrier formed from the modified blank of FIG. 7.
Figure 9:
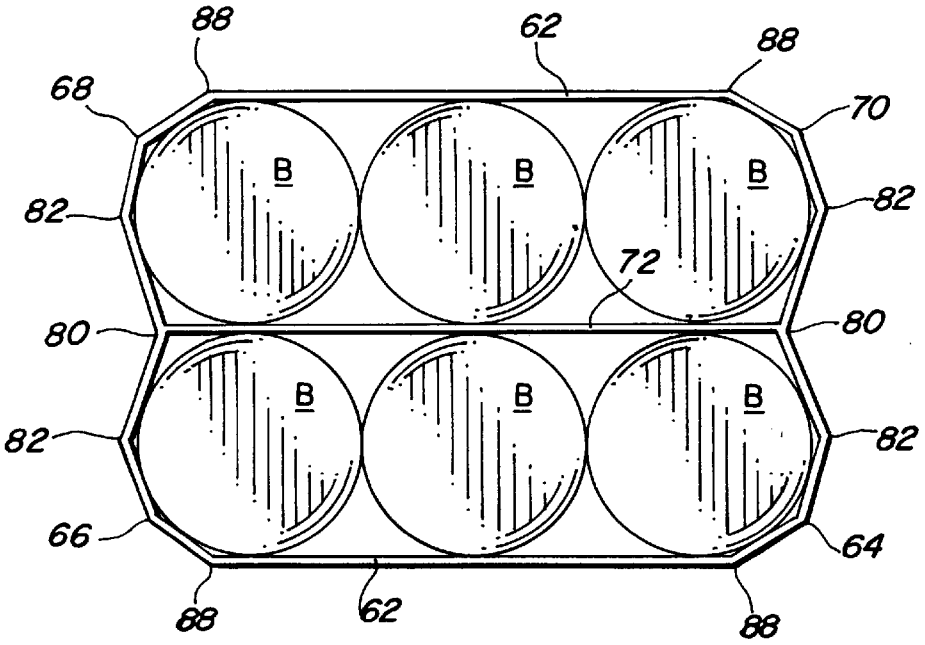
FIG. 9 is a plan view of the carrier of FIG. 8 after being loaded with bottles.

The same procedures discussed above in connection with the forming of the first embodiment are used to form a collapsed carrier of the second embodiment and subsequently to open it for loading, resulting in the carrier shown in FIG. 8. The carrier is illustrated in a view similar to that of FIG. 1. When the carrier is fully constructed but not yet loaded, the end panels and side panels can be seen to extend at substantially right angles to each other, meeting at the fold lines 64, 66, 68 and 70. When the bottles are loaded into the formed carrier, however, the tight fit of the bottles forces the portions of the side and end panels between the vertical fold lines to substantially follow the contour of the curved bottles. As illustrated in FIG. 9, the end panel is folded outwardly about the central fold lines 80, then inwardly about the fold lines 82 to the corner fold lines 64, 66, 68 and 70. The side panels are also folded inwardly about the fold lines 88 to the corner fold lines. This tight configuration is added protection against the possibility of bottle movement within the carrier.

The blanks 60 of the second embodiment are nestable in a manner similar to the arrangement of the blanks 32 shown in FIG. 6. The upper edge of the handle reinforcement flap of the blanks abuts the lower edge of the handle panel of the one adjacent blank and the lower edges of the bottom panel flaps 90 and 92 abut the upper edges of the side panel sections 62 of the other adjacent blank. As in the first embodiment, this leaves only small gaps between the end panel flaps and the end panel sections, which substantially correspond to the height of the handle reinforcement flaps.

It will be appreciated that the minimal use of carrier stock coupled with the nestable layout of the carrier blanks results in a highly desirable economical carrier. Despite the economy of production, the carrier of the invention is quite strong and rigid, capable of adequately supporting heavy loads, and has the advantage of displaying greater portions of the packaged bottles than in conventional carriers. Although the carrier has been described in connection with the packaging of bottles, it will be understood that it may be used to package other types of articles as well.

The thickness of the paperboard has been exaggerated in the drawings for the sake of clarity. It will be understood that in the actual carrier the thickness of the panels is quite small compared to the dimensions of the carrier.

Although the carriers have been illustrated as having straight upper side edges and rounded upper end panel portions, these shapes may be changed to suit design tastes. For example, the side panels may be provided with an irregular upper edge, in which case the bottom panel flaps would have an inversely shaped edge in order for the blanks to nest as desired. Because of the spaces between the end panel flaps and end panel sections of adjacent blanks in a web layout, there need be no corresponding change to other carrier elements if it is desired to alter the shape of the end panels.

It should also be understood that the invention is not limited to all the specific details described in connection with the preferred embodiments, except as they may be within the scope of the appended claims, and that changes to certain features of the preferred embodiment which do not alter the overall basic function and concept of the invention are contemplated.

What is claimed is:

1. A basket-style carrier, comprising:

a bottom panel;

a pair of opposite end panels, one of the end panels being comprised of two partially overlapping end panel sections, the other end panel being of integral construction;

a pair of opposite side panels connected to the bottom panel and to the end panels;

a central handle panel having opposite ends, one of the handle panel ends being foldably connected to one of the end panel sections of said one end panel, the other handle panel end being foldably connected to a glue flap adhered to said other end panel;

the handle panel and the end panels having upper edges, the upper edges of the end panels terminating at substantially the upper edge of the handle panel, said handle panel including a handle reinforcement flap foldably connected to the upper edge of the handle panel, the handle panel and the handle reinforcement flap containing aligned handle openings, the handle panel being spaced from the bottom panel a distance substantially equal to the height of the handle reinforcement flap; and wherein the end panels have lower edges at least portions of which are spaced from the bottom panel, the portions of the lower edges of the end panels adjacent the handle panel being spaced from the bottom panel a distance substantially equal to the height of the handle reinforcement flap.

2. A basket-style carrier as defined in claim 1, wherein the end panels and the side panels contain vertical fold lines, whereby portions of the end and side panels between the vertical fold lines are able to fold to positions substantially conforming to curved surfaces of adjacent packaged articles.

3. An elongated blank for forming a basket-style carrier, comprising;

an end panel section;

first and second side panel sections foldably connected to opposite edges of the end panel section;

a partial end panel flap foldably connected to the first side panel section;

a partial end panel section foldably connected to the second side panel section;

a handle panel section foldably connected to the partial end panel section and to a glue flap;

the side panel sections, the handle panel section, the end panel section, the partial end panel flap and the partial end panel section having upper and lower edges;

a handle-reinforcing flap foldably connected to the upper edge of the handle panel section;

the lower edges of the side panel sections lying in a common plane, the lower edge of the handle panel section lying in a plane upwardly spaced from said common place a distance substantially equal to the height of the handle reinforcing flap; and bottom panel flaps foldably connected to the lower edges of the side panel sections, portions of the lower edges of the end panel section, the partial end panel flap and the partial end panel section are spaced from said common plane, at a point corresponding to a point midway between the side panels of a carrier formed from the blank, a distance substantially equal to the height of the handle reinforcement flap.

4. A basket-style carrier blank as defined in claim 3, wherein the end panel section, the partial end panel flap and the partial end panel section contain vertical fold lines, whereby portions of the blank between the vertical fold lines are able to fold to positions substantially conforming to curved surfaces of adjacent articles packaged in a carrier formed from the blank.

5. A web layout of a plurality of adjacent elongated basket-style carrier blanks for forming basket-style carriers, each blank comprising:

an end panel section;

first and second side panel sections foldably connected to opposite edges of the end panel section;

a partial end panel flap foldably connected to the first side panel section;

a partial end panel section foldably connected to the second side panel section;

a handle panel section foldably connected to the partial end panel section and to a glue flap;

the side panel sections, the handle panel section, the end panel section, the partial end panel flap and the partial end panel section having upper and lower edges;

a handle reinforcing flap having upper and lower edges, the lower edge of the handle reinforcing flap being foldably connected to the upper edge of the handle panel section;

the lower edges of the side panel sections lying in a common plane, the lower edge of the handle panel section lying in a plane upwardly spaced from said common plane a distance substantially equal to the height of the handle reinforcing flap; and bottom panel flaps foldably connected to the lower edges of the side panel sections;

the blanks being arranged such that the upper edge of the handle reinforcing flap of one blank abuts the lower edge of the handle panel section of an adjacent blank.

6. A basket-style carrier blank web layout as defined in claim 5, wherein portions of the lower edges of the end panel section, the partial end panel flap and the partial end panel section of each blank which are designed to be midway between the side panels of a carrier formed from the blank are substantially aligned with the lower edge of the handle panel section of the blank.

* * * * *